US010454176B2

(12) United States Patent
Koga et al.

(10) Patent No.: US 10,454,176 B2
(45) Date of Patent: Oct. 22, 2019

(54) ANTENNA APPARATUS AND ELECTRONIC DEVICE

(71) Applicant: FUJITSU LIMITED, Kawasaki-shi, Kanagawa (JP)

(72) Inventors: Yohei Koga, Kawasaki (JP); Takashi Yamagajo, Yokosuka (JP); Manabu Kai, Yokohama (JP); Mitsuharu Hoshino, Kawasaki (JP); Masatomo Mori, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/832,096

(22) Filed: Dec. 5, 2017

(65) Prior Publication Data

US 2018/0183149 A1 Jun. 28, 2018

(30) Foreign Application Priority Data

Dec. 28, 2016 (JP) ..... 2016-256728

(51) Int. Cl.

| | |
|---|---|
| ***H01Q 9/40*** | (2006.01) |
| ***H01Q 9/38*** | (2006.01) |
| ***H01Q 21/00*** | (2006.01) |
| ***H01Q 1/48*** | (2006.01) |
| ***H01Q 1/24*** | (2006.01) |
| ***H01Q 9/42*** | (2006.01) |
| ***H01Q 21/28*** | (2006.01) |

(Continued)

(52) U.S. Cl.

CPC ..... *H01Q 9/38* (2013.01); *H01Q 1/243* (2013.01); *H01Q 1/48* (2013.01); *H01Q 5/35* (2015.01); *H01Q 9/42* (2013.01); *H01Q 21/0006* (2013.01); *H01Q 21/28* (2013.01); *H01Q 1/52* (2013.01)

(58) Field of Classification Search

CPC ..... H01Q 1/243; H01Q 1/48; H01Q 1/52; H01Q 9/40–9/42

USPC ..... 343/700 MS, 702, 846–848

See application file for complete search history.

(56) References Cited

U.S. PATENT DOCUMENTS 7,079,079 B2 * 7/2006 Jo ..... H01Q 1/243 343/700 MS
7,289,068 B2 * 10/2007 Fujio ..... H01Q 9/0407 343/700 MS (Continued)

FOREIGN PATENT DOCUMENTS

JP 2007-281990 A 10/2007

*Primary Examiner* — Dameon E Levi
*Assistant Examiner* — Hasan Z Islam
(74) *Attorney, Agent, or Firm* — Arent Fox LLP

(57) ABSTRACT

An antenna apparatus includes a ground plane having an edge; a monopole type first antenna element having a first feed point and configured to communicate at a first frequency; and a monopole type second antenna element having a second feed point and configured to communicate at a second frequency, the second antenna element extending from the second feed point in a direction away from the edge. An end portion of the first antenna element is arranged closer to the ground plane than an end portion of the second antenna element is. A length of an interval between the first feed point and the second feed point is in a range of from 0.25-fold to 0.7-fold of an electrical length of a first wavelength at the first frequency. A length of the second antenna element is a length in a range of from 0.15-fold to 0.55-fold of the electrical length.

5 Claims, 12 Drawing Sheets

(51) Int. Cl.
*H01Q 5/35* (2015.01)
*H01Q 1/52* (2006.01)

(56) References Cited

U.S. PATENT DOCUMENTS

| | | | | |
|---|---|---|---|---|
| 9,196,957 | B2 * | 11/2015 | Kim | H01Q 1/521 |
| 2007/0236394 | A1 | 10/2007 | Aoyama et al. | |
| 2009/0009401 | A1 * | 1/2009 | Suzuki | H01Q 1/242<br>343/700 MS |
| 2011/0102268 | A1 * | 5/2011 | Watanabe | H01Q 1/243<br>343/700 MS |
| 2014/0085164 | A1 * | 3/2014 | Kashiwagi | H01Q 21/00<br>343/893 |

* cited by examiner

ANTENNA APPARATUS AND ELECTRONIC DEVICE

CROSS-REFERENCE TO RELATED APPLICATION

This application is based upon and claims the benefit of priority of the prior Japanese Patent Application No. 2016-256728 filed on Dec. 28, 2016, the entire contents of which are incorporated herein by reference.

FIELD

The embodiment discussed herein relates to an antenna apparatus and an electronic device.

BACKGROUND

Conventionally, there exists an antenna device that includes a first antenna that is a chip-type antenna for operating in a GSM band, a second antenna that is a pattern antenna for operating in DCS and PCS bands, and a third antenna that is a stacked antenna for operating in an UMTS band. The antennas are provided on a substrate. The second antenna is provided via a line extending from a power feeding port connected to the first antenna. A gap G is interposed between the second antenna and the third antenna on the substrate such that the second antenna is capacitively coupled to the third antenna without providing an antenna switch (see Patent Document 1, for example).

Here, in the above antenna apparatus, the second antenna is capacitively coupled to the third antenna for impedance matching but is not provided to improve efficiency (radiation efficiency, in particular) of the antenna apparatus.

RELATED-ART DOCUMENTS

Patent Documents

[Patent Document 1] Japanese Laid-open Patent Publication No. 2007-281990

SUMMARY

According to an aspect of the embodiments, an antenna apparatus includes: a ground plane having an edge; a monopole type first antenna element having a first feed point and configured to communicate at a first frequency; and a monopole type second antenna element having a second feed point and configured to communicate at a second frequency, the monopole type second antenna element extending from the second feed point in a direction away from the edge, wherein an end portion of the first antenna element is arranged closer to the ground plane than an end portion of the second antenna element is, wherein a length of an interval between the first feed point and the second feed point is in a range of from 0.25-fold to 0.7-fold of an electrical length of a first wavelength at the first frequency, and wherein a length of the second antenna element is a length in a range of from 0.15-fold to 0.55-fold of the electrical length of the first wavelength.

The object and advantages of the invention will be realized and attained by means of the elements and combinations particularly pointed out in the claims. It is to be understood that both the foregoing general description and the following detailed description are exemplary and explanatory and are not restrictive of the invention.

DESCRIPTION OF EMBODIMENT

Hereinafter, an embodiment to which an antenna apparatus and an electronic device of the present invention are applied will be described. An object in one aspect of the embodiment is to provide an antenna apparatus and an electronic device that have improved efficiency.

Embodiment

Figure 1:
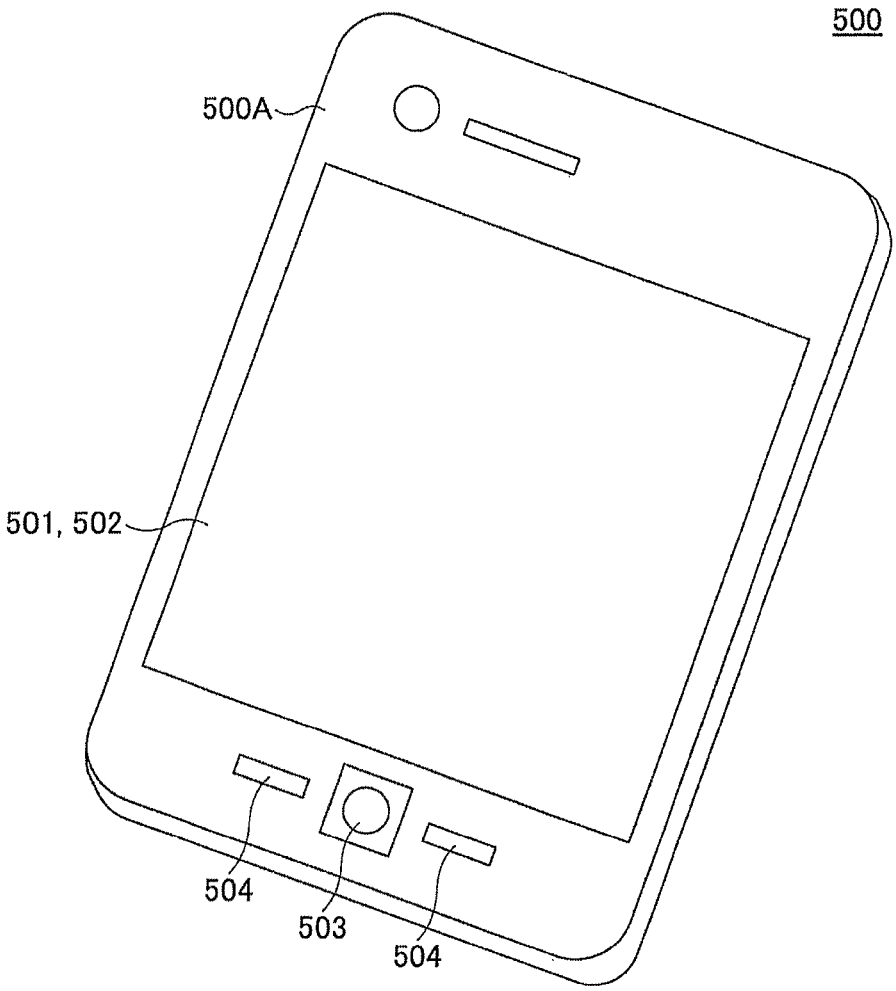
FIG. 1 is a perspective view illustrating a front surface side of a tablet computer 500 including an antenna apparatus according to an embodiment.

FIG. 1 is a perspective view illustrating a front surface side of a tablet computer 500 including an antenna apparatus according to an embodiment. The tablet computer 500 is an example of an electronic device including an antenna apparatus according to an embodiment.

A touch panel 501 and a display panel 502 are disposed at the front surface side of a housing 500A of the tablet computer 500. A home button 503 and switches 504 are disposed below the touch panel 501. The touch panel 501 is provided at a display surface side of the display panel 502.

Note that an electronic device including an antenna apparatus according to an embodiment is not limited to the tablet computer 500, but may be a smartphone terminal device, a portable phone terminal device, a game machine, or the like.

Figure 2:
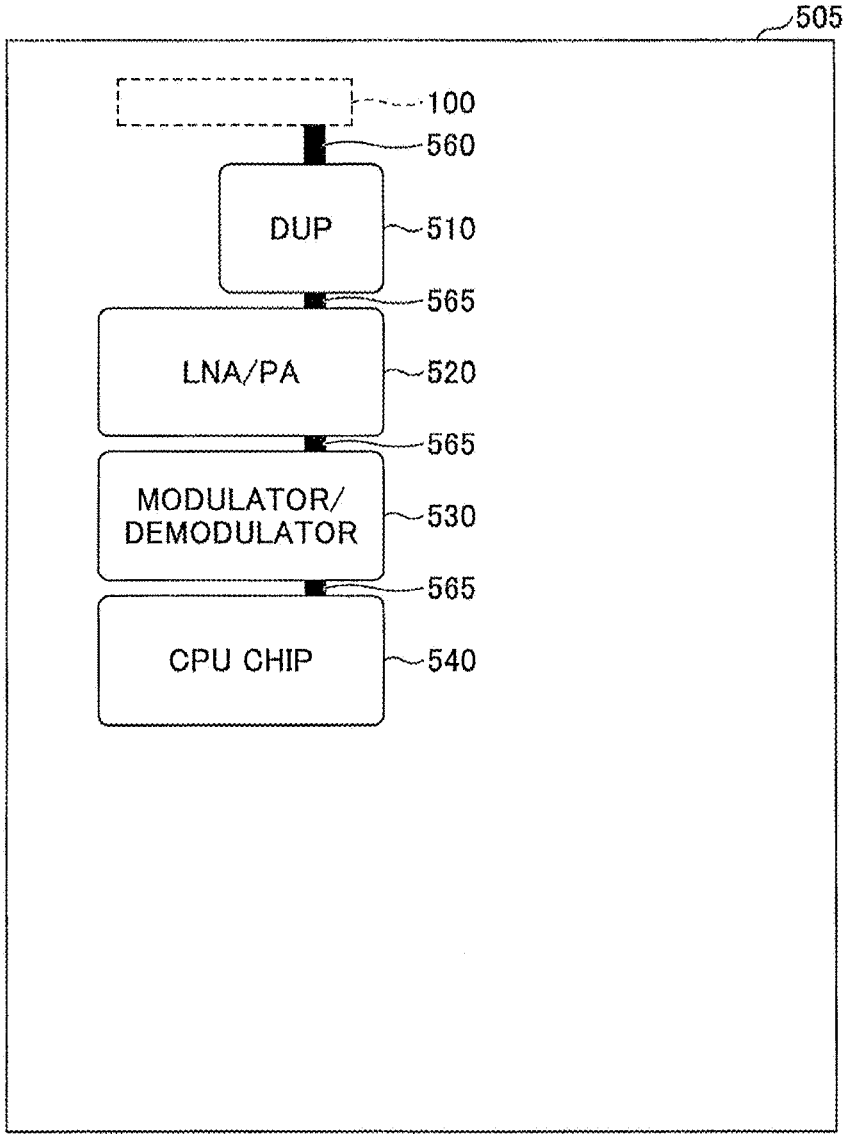
FIG. 2 is a wiring substrate 505 of the tablet computer 500.

FIG. 2 is a wiring substrate 505 of the tablet computer 500.

The wiring substrate 505 is disposed inside the housing 500A (see FIG. 1). On the wiring substrate 505, a Duplexer (DUP) 510, a Low Noise Amplifier/Power Amplifier (LNA/PA) 520, a modulator/demodulator 530, and a Central Processing Unit (CPU) chip 540 are mounted.

Further, on a surface opposite to a surface of the wiring substrate 505 on which the DUP 510, the LNA/PA 520, the modulator/demodulator 530, and the CPU chip 540 are mounted, the antenna apparatus 100 according to the embodiment is disposed. As details of the configuration of the antenna apparatus 100 will be described later below, the position of the antenna apparatus 100 is illustrated by a broken line in FIG. 2.

The DUP 510, the LNA/PA 520, the modulator/demodulator 530, and the CPU chip 540 are coupled through a wire 565.

The DUP 510 is coupled to the antenna apparatus 100 through a wire 560 and a via hole or the like (not illustrated), and switches transmission or reception. Because the DUP 510 has a function as a filter, in a case where the antenna apparatus 100 receives a plurality of signals of frequencies, the DUP 510 can separate the respective signals of the frequencies.

The LNA/PA 520 amplifies electric power of a transmission wave and a reception wave. The modulator/demodulator 530 modulates the transmission wave and demodulates the reception wave. The CPU chip 540 has a function as a communication processor that performs a communication process of the tablet computer 500 and a function as an application processor that executes an application program. Note that the CPU chip 540 includes an internal memory that stores data such as data to be transmitted and received data.

Note that the wires 560 and 565 are formed by patterning a copper foil of a surface of the wiring substrate 505, for example. Further, a matching circuit (not illustrated in FIG. 2) is provided between the antenna apparatus 100 and the DUP 510 for adjusting impedance characteristics.

Figure 3:
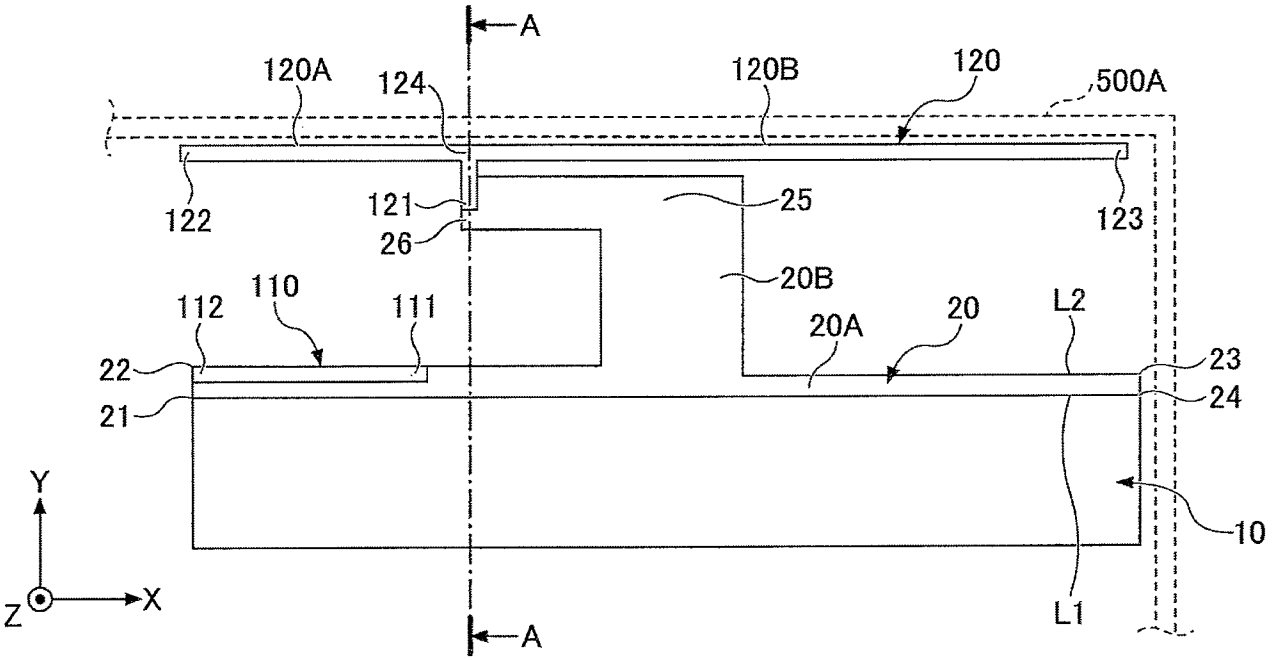
FIG. 3 is a plan view illustrating the antenna apparatus 100 according to the embodiment.
Figure 4:
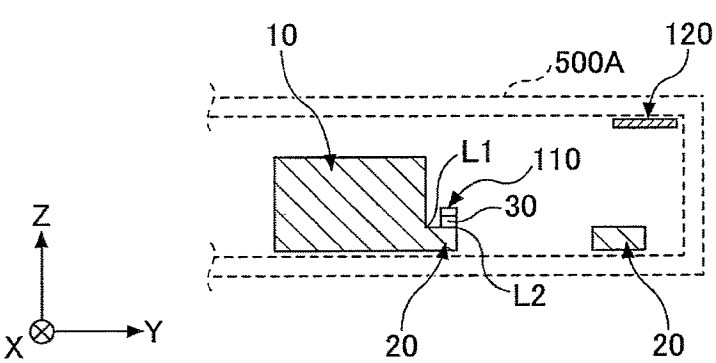
FIG. 4 is a cross-sectional view of the antenna apparatus 100 taken along the line A-A of FIG. 3.

FIG. 3 is a plan view illustrating the antenna apparatus 100 according to the embodiment. FIG. 4 is a cross-sectional view of the antenna apparatus 100 taken along the line A-A of FIG. 3. For example, the antenna apparatus 100 is disposed to be located close to the switches 504 of the tablet computer 500 (see FIG. 1).

The antenna apparatus 100 includes a ground plane 20, a radiating element 110, and a radiating element 120. In the following description, an XYZ coordinate system, which is an orthogonal coordinate system, is used.

For example, the antenna apparatus 100 is attached to a metal plate 10 included inside of the housing 500A of the tablet computer 500 (see FIG. 1).

The metal plate 10 is a metal plate thicker than the ground plane 20, and is held at a ground potential. For example, the metal plate 10 is a sheet metal provided at the side opposite to the display surface of the display panel 502 of the tablet computer 500 (see FIG. 1). In this case, the metal plate 10 is provided to reinforce the display panel 502. The metal plate 10 is provided at the back side of the wiring substrate 505 illustrated in FIG. 2.

To the metal plate 10, one or more electronic components required for realizing functions of an electronic device may be coupled such as a Central Processing Unit (CPU) chip, and/or a memory. Note that the metal plate 10 is not limited to have such a configuration, and may be a metal plate included in the electronic device described above. It is not required for the electronic device to include a display panel.

The ground plane 20 is a metal layer coupled with a side L1 parallel to the X axis of the metal plate 10, and is held at a ground potential. The ground plane 20 is a metal layer that includes a rectangular ground part 20A having vertices 21, 22, 23, and 24 and a ground part 20B that protrudes from a side L2, which connects the vertex 22 and the vertex 23, towards the positive side in the Y axis direction in a L-shape.

The ground part 20B protrudes from the side L2 towards the positive side in the Y axis direction, and bends towards the negative side in the X axis direction at a bend part 25 to extend to an end portion 26. Note that the ground plane 20 may extend farther than the vertices 21 and 22 towards the negative side in the X axis direction, and may extend farther than the vertices 23 and 24 towards the positive side in the X axis direction.

Both the side L1, which connects the vertex 21 and the vertex 24, and the side L2, which connects the vertex 22 and the vertex 23, are parallel to the X axis. Both the side, which connects the vertex 21 and the vertex 22, and the side, which connects the vertex 24 and the vertex 23, are parallel to the Y axis. The side L1 is opposite to the side L2 and is an edge of the ground plane 20.

The ground plane 20 serves as a ground plane of the antenna apparatus 100. For example, the ground plane 20 is a plated layer formed on an inside surface of the housing 500A. Note that the plated layer may be created by plating such as copper plating or other metallic plating, for example. The ground plane 20 may be realized by a metallic foil attached to the surface of the wiring substrate 505.

The radiating element 110 is mounted at a positive side in the Z axis direction of the ground part 20A of the ground plane 20 via a spacer 30 made of a resin. The radiating element 110 is a linear metallic conductor that has a feed point 111 and an end portion 112. Similar to the ground plane 20, the radiating element 110 can be created by plating such as copper plating or other metallic plating. Also, the radiating element 110 may be a linear copper foil.

The radiating element 110 is an example of a monopole type first antenna element. The radiating element 110 extends along the side L2 in a plan view, and has the feed point 111 and the end portion 112 at both ends. The end portion 112 is located at a position that is the same as the vertex 21 in the plan view. Note that the feed point 111 is an example of a first feed point.

From the feed point 111 to the end portion 112, the height (the length in the Z axis direction) of the radiating element 110 with respect to the ground plane 20 is constant. For example, the feed point 111 is coupled to a core wire of a coaxial cable, and a point of the ground plane 20 located directly below (on the negative side in the Z axis direction) the feed point 111 in a plan view is coupled to a shielded wire of the coaxial cable. Thereby, power is fed to the radiating element 110.

A communication frequency of the radiating element 110 is f1, and the length of the radiating element 110 is set to be a quarter wavelength of an electrical length of a wavelength $\lambda_1$ at the communication frequency f1. That is, the radiating element 110 communicates at the frequency f1 and the length from the feed point 111 to the end portion 112 is set to be $\lambda_1/4$. Hence, the radiating element 110 serves as a monopole antenna in collaboration with the ground plane 20.

The radiating element 110 is arranged closer to the ground plane 20 than the radiating element 120 is. The feed point 111 is arranged closer to the ground plane 20 than the feed point 121 of the radiating element 120 is. Further, the end portion 112 is arranged closer to the ground plane 20 than the end portion 122 of the radiating element 120 is. Note that the feed point 121 is an example of a second feed point.

Because the radiating element 110 is closer to the ground plane 20 than the radiating element 120 is, the coupling strength between the radiating element 110 and the ground plane 20 is stronger than the coupling strength between the radiating element 120 and the ground plane 20, and the radiation efficiency of the radiating element 110 alone is lower than the radiation efficiency of the radiating element 120 alone. In addition to radiation of the radiating element 110 itself, the radiating element 110 also radiates via the radiating element 120 to secure the radiation efficiency at the communication frequency f1. The fundamentals of such a radiating element 110 will be described later below.

The spacer 30 is a thin plate shaped member made of a resin. The spacer 30 has a size substantially equal to that of the radiating element 110 in a plan view. The spacer 30 is provided to arrange the radiating element 110. For example, the spacer 30 can be created by a material similar to the housing 500A. The spacer 30 is attached to the positive side of the ground part 20A of the ground plane 20. The radiating element 110 is disposed on the positive side in the Z axis direction of the spacer 30.

Note that although the spacer 30 is used to arrange the radiating element 110 on the positive side of the ground plane 20 in the Z axis direction in the embodiment described here, the radiating element 110 may be provided on an end portion of a protruding part that protrudes from an inner wall of the housing 500A towards the negative side in the Z axis direction without using a spacer 30.

The radiating element 120 is attached to an inner wall of the housing 500A. The radiating element 120 is a T-shaped radiating element that has a feed point 121, an end portion 122, and a branch end 123. Similar to the ground plane 20 and the radiating element 110, the radiating element 120 can be created by plating such as copper plating or other metallic plating. Also, the radiating element 110 may be a T-shaped copper foil. In this case, the radiating element 110 may be attached to an inner wall of the housing 500A.

The feed point 121 is arranged at a position that is the same as the end portion 26 of the ground plane 20 in a plan view. In the plan view, the feed point 121 is located at an approximately central position of the end portion 26 in the width direction of the Y axis direction.

The radiating element 120 extends from the feed point 121 towards the positive side in the Y axis direction, and bends at the bend part 124 towards the negative side in the X axis direction to extend to the end portion 122. Within the radiating element 120, a part extending from the feed point 121 to the end portion 122 via the bend part 124 is an example of a monopole type second antenna element. This part is referred to as the radiation part 120A hereinafter.

Further, the radiating element 120 has a section that branches off from the bend part 124 towards the positive side in the X axis direction to extend to the branch end 123. This section is an example of a branch element. Within the radiating element 120, a part extending from the feed point 121 to the branch end 123 via the bend part 124 is referred to as the radiation part 120B.

In the section from the feed point 121 to the end portion 122, the height of the radiating element 120 with respect to the ground plane 20 (distance in the Z axis direction) is constant. In the section from the bend part 124 to the branch end 123, the height of the radiating element 120 with respect to the ground plane 20 (distance in the Z axis direction) is constant. The radiating element 120 is arranged at a position higher than that of the radiating element 110.

For example, the feed point 121 is coupled to a core wire of a coaxial cable, and a point of the ground plane 20 (which is a point of the ground plane 20 corresponding to the feed point 121 and is a substantially central point in the width direction of the Y axis direction of the end portion 26) located directly below (located at the negative side in the Z axis direction of) the feed point 121 in a plan view is coupled to a shielded wire of the coaxial cable. Thereby, power is fed to the radiating element 120.

A communication frequency of the radiation part 120A is f2, and the length of the radiation part 120A is set to be a quarter wavelength of an electrical length of a wavelength $\lambda_2$ at the communication frequency f2. That is, the radiation part 120A communicates at the frequency f2 and the length from the feed point 121 to the end portion 122 is set to be $\Delta_2/4$. Hence, the radiation part 120A serves as a monopole antenna in collaboration with the ground plane 20. Because the length of the radiation part 120A is longer than the length of the radiating element 110, the communication frequency f2 is lower than the communication frequency f1.

Further, a communication frequency of the radiation part 120B is f3, and the length of the radiation part 120B is set to be a quarter wavelength of an electrical length of a wavelength $\lambda_3$ at the communication frequency f3. That is, the length from the feed point 121 to the branch end 123 is set to be $\lambda_3/4$. Hence, the radiation part 120B serves as a monopole antenna in collaboration with the ground plane 20. Because the length of the radiation part 120B is longer than the length of the radiating element 110 and the length of the radiation part 120A, the communication frequency f3 is lower than the communication frequency f1 and the communication frequency f2.

The radiating element 120 is arranged farther away from the ground plane 20 than the radiating element 110 is. The feed point 121 is arranged farther away from the ground plane 20 than the feed point 111 of the radiating element 110 is. Further, the end portion 122 is arranged farther away from the ground plane 20 than the end portion 112 of the radiating element 110 is. Further, the branch end 123 is arranged farther away from the ground plane 20 than the end portion 112 of the radiating element 110 is.

Because the radiating element 120 is located farther away from the ground plane 20 than the radiating element 110 is, the coupling strength between the radiating element 120 and the ground plane 20 is weaker than that between the radiating element 110 and the ground plane 20, and the radiation efficiency of the radiating element 120 alone is higher than that of the radiating element 110. In addition to radiating at the communication frequencies f2 and f3, the radiating element 120 supports radiation of the radiating element 110. The fundamentals of such a radiating element 120 will be described later below.

Figure 5:
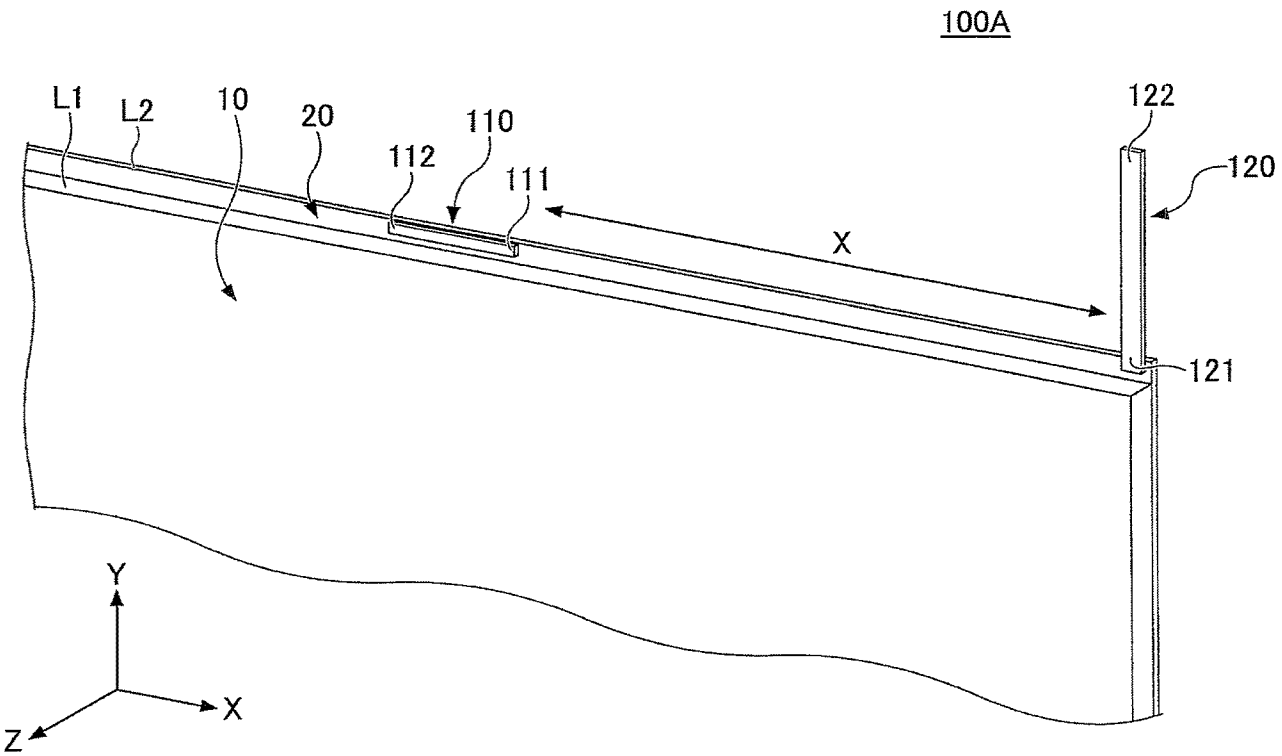
FIG. 5 is a diagram illustrating a simulation model 100A.

FIG. 5 is a diagram illustrating a simulation model 100A. The simulation model 100A is a simulation model of the antenna apparatus 100 illustrated in FIG. 3 and FIG. 4.

The simulation model 100A is obtained by omitting the ground part 20B (see FIG. 3) of the ground plane 20, locating the feed point 121 on the side L2, and making the radiating element 120 into a linear antenna element that extends towards the positive side in the Y axis direction. In the simulation model 100A, the radiating element 120 is a monopole type element that has the feed point 121 and the end portion 122 as both ends and has an electrical length of $\lambda_2/4$.

A positional relationship of the feed points 111 and 121 with the ground plane 20 of the simulation model 100A is similar to that illustrated in FIG. 3 and FIG. 4. Note that the ground plane 20 extends farther than the end portion 112 of the radiating element 110 towards the negative side in the X axis direction.

Figure 6:
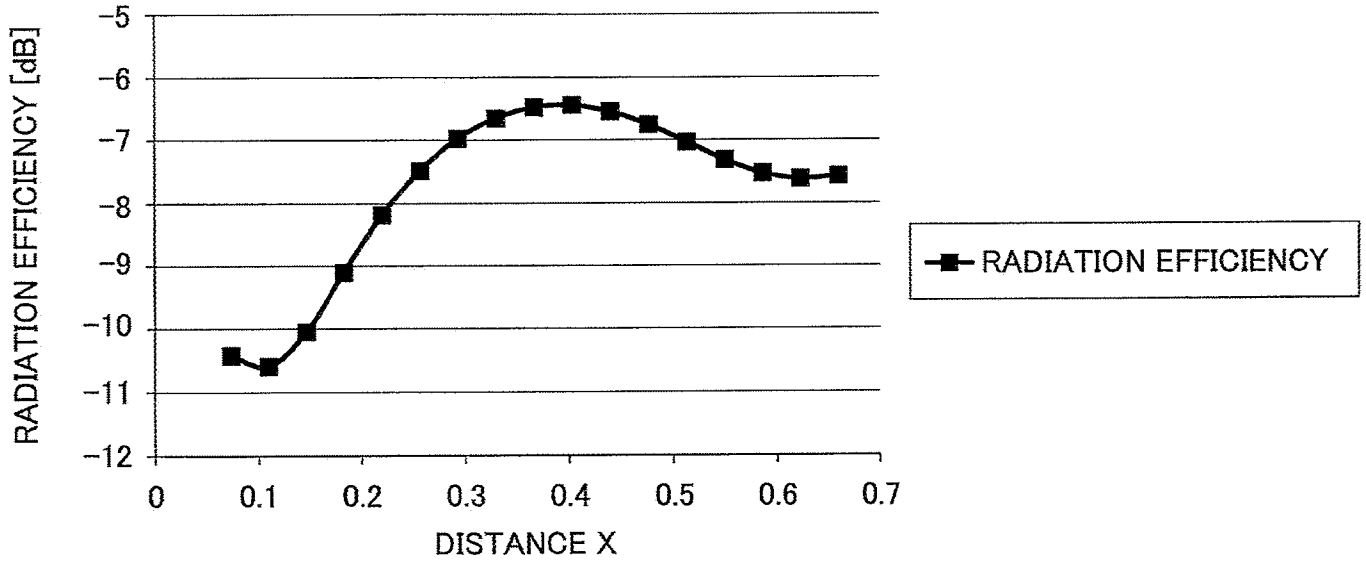
FIG. 6 is a diagram illustrating a property of a radiation efficiency of a radiating element 110 with respect to a distance X between the radiating element 110 and a radiating element 120.

In such a simulation model 100A, power is fed only to the radiating element 110 while moving the radiating element 110 in the X axis direction to change the position of the radiating element 110 with respect to the radiating element 120. FIG. 6 illustrates an obtained result. Note that the feed point 121 of the radiating element 120 is terminated by a 50Ω resistor.

FIG. 6 is a diagram illustrating a property of a radiation efficiency of the radiating element 110 with respect to the distance X between the radiating element 110 and the radiating element 120. More specifically, the distance X is a distance between the feed point 111 of the radiating element 110 and the feed point 121 of the radiating element 120.

In FIG. 6, the horizontal axis represents a numerical value obtained by standardizing (dividing) the distance X by the wavelength $\lambda_1$. For example, when a value of the horizontal axis is 0.3, the distance X is $0.3\times\lambda_1$ ($0.3\lambda_1$). Further, the vertical axis represents a radiation efficiency (dB) of the radiating element 110 for when power is fed only to the radiating element 110.

In FIG. 6, when the distance X is $0.07\lambda_1$, the feed point 111 of the radiating element 110 and the feed point 121 of the radiating element 120 are closest. In FIG. 6, when the distance X is $0.66\lambda_1$, the feed point 111 of the radiating element 110 and the feed point 121 of the radiating element 120 are farthest.

As the distance X increases, the radiation efficiency increases from approximately −10.5 dB, and becomes the maximum value, which is approximately −6.5 dB, when the distance is $0.33\lambda_1$. As the distance X further increases, the radiation efficiency becomes substantially constant around −7.5 dB when the distance is greater than or equal to $0.6\lambda_1$. Further, although it is not illustrated in FIG. 6, it can be confirmed that the radiation efficiency for when the distance X is longer than $0.66\lambda_1$ is similar to that for when the distance X is in a range of from $0.6\lambda_1$ to $0.66\lambda_1$.

As described above, it is found that when the radiating element 110 and the radiating element 120 are close, the radiation efficiency of the radiating element 110 decreases. Further, it is found that as the radiating element 110 and the radiating element 120 separate, the radiation efficiency of the radiating element 110 increases, and the radiation efficiency becomes high when the distance X is in a range of from approximately $0.3\lambda_1$ to approximately $0.4\lambda_1$.

It is considered that the reason why the radiation efficiency of the radiating element 110 is low when the radiating element 110 and the radiating element 120 are close is because the metal (the radiating element 120) is arranged close to the radiating element 110 to which power is fed and the coupling between the radiating element 110 and the radiating element 120 is too strong.

Further, it is considered that the reason why the radiation efficiency is substantially constant when the distance X is longer than or equal to $0.66\lambda_1$ is because when the distance X is longer than or equal to $0/66\lambda_1$, the degree of coupling between the radiating element 110 and the radiating element 120 is a negligible degree and the radiating element 120 does not affect the radiation of the radiating element 110. In other words, it is considered that a case in which the distance X is longer than or equal to $0.66\lambda_1$ is equivalent to a case in which the radiating element 110 is present alone and radiates without the presence of a radiating element 120.

Here, the value of the radiation efficiency for when the distance X is approximately $0.25\lambda_1$ is substantially equal to a value of the radiation efficiency for when the distance X is longer than or equal to $0.66\lambda_1$. The value of the radiation efficiency for when the distance X is in a range from approximately $0.25\lambda_1$ to approximately $0.60\lambda_1$ is greater than or equal to a value of the radiation efficiency for when the distance X is longer than or equal to $0.66\lambda_1$.

It is considered that this is because radio waves radiated by the radiating element 110 are reradiated by the radiating element 120 in a state in which the radiating element 110 and the radiating element 120 are moderately coupled.

Here, the total efficiency E1 in a case where the radiating element 110 is present alone without the presence of a radiating element 120 is obtained by the following formula (1). In the case where the radiating element 110 is present alone, the total efficiency E1 can be obtained by subtracting a return loss from the radiation efficiency of the radiating element 110.

$$\text{TOTAL EFFICIENCY } E1 = \text{RADIATION EFFICIENCY} - \text{RETURN LOSS} \quad (1)$$

The total efficiency E1 is specifically obtained as the total efficiency E1=−7.27138-0.19871=−7.47009 dB.

Further, the total efficiency E2 in a case where both the radiating elements 110 and 120 are present and the distance X is $0.33\lambda_1$ can be obtained by the following formula (2). In the case where both the radiating elements 110 and 120 are present and only the radiating element 110 radiates, the total efficiency E2 can be obtained by subtracting a return loss and a coupling loss from the radiation efficiency of the radiating element 110. The coupling loss is a loss generated by the radiating elements 110 and 120 being electromagnetically coupled.

$$\text{TOTAL EFFICIENCY } E2 = \text{RADIATION EFFICIENCY} - \text{RETURN LOSS} - \text{COUPLING LOSS} \quad (2)$$

The total efficiency E2 is specifically obtained as the total efficiency E2==−6.75103−0.18304−0.08131=−7.01538 dB. This is lower than the total efficiency E1 (which is 7.47009 dB) and is a preferable value by approximately 0.4 dB. Note that in the case in which the distance X is set to be $0.33\lambda_1$, an inductor is inserted in series with (loaded at) the feed point 111 and/or a capacitor is coupled in parallel with (loaded at) the feed point 111.

Here, in a case where the radiating element 110 is present alone, the return loss is 0.19871. In a case where both of the radiating elements 110 and 120 are present and only the radiating element 110 radiates, the return loss is 0.18304. This means that, for the radiating element 110, the value of impedance does not change substantially regardless of the presence or absence of the radiating element 120. It is considered that the return loss may further decrease if the impedance is matched.

By the presence of the radiating element 120 in addition to the radiating element 110, the radiation efficiency increases from −7.27138 to −6.75103 relative to the case in which the radiating element 110 is used alone.

As described above, even when the radiating element 120 is used, the return loss has a similar value and the radiation efficiency is improved. Therefore, it is considered that radio waves radiated from the radiating element 110 are reradiated by the radiating element 120. In a case where the distance X is in a range of from approximately $0.25\lambda_1$ to approximately $0.66\lambda_1$, the radiation efficiency represents a value greater than or equal to that in a case where the distance X is greater than or equal to $0.66\lambda_1$. It is considered that the radiation of the radiating element 110 is supported by the radiating element 120.

FIGS. 7A and 7B and FIGS. 8A and 8B are diagrams illustrating simulation models 100B and 100C.

Figure 7A:
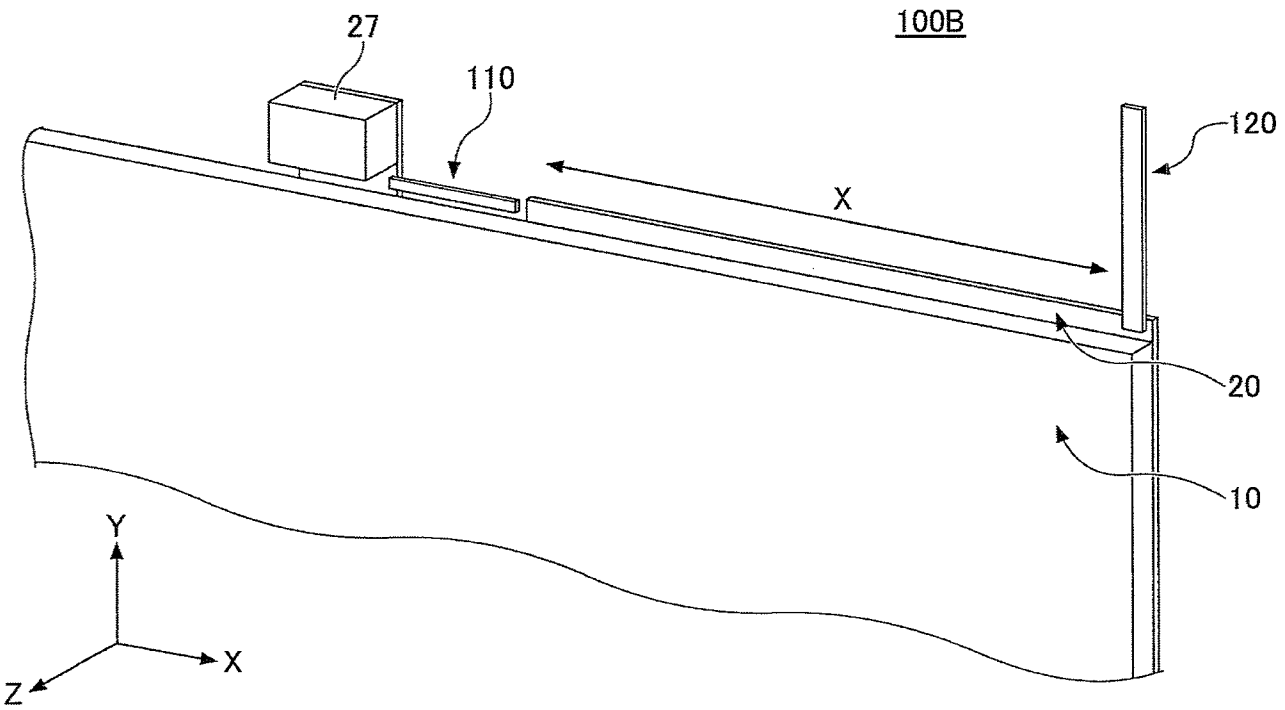
FIGS. 7A and 7B are diagrams illustrating a simulation model 100B.
Figure 7B:
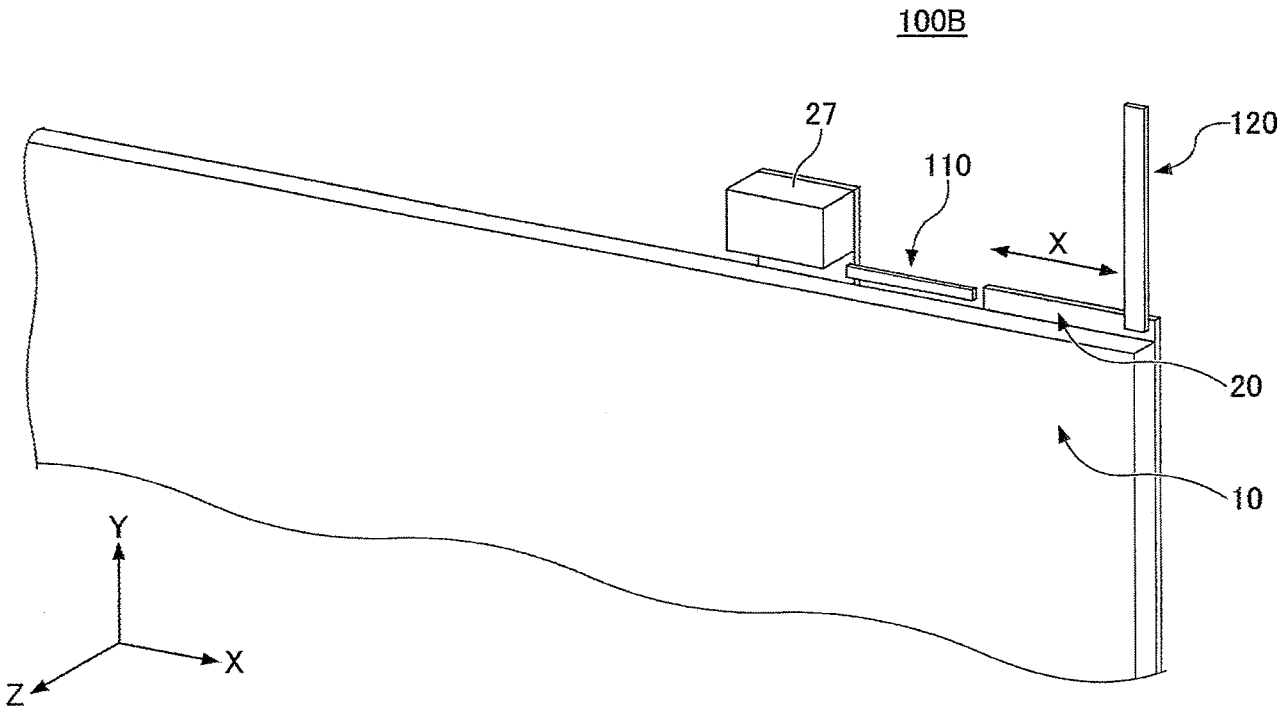

The simulation model 100B illustrated in FIGS. 7A and 7B is a simulation model obtained by adding, to the negative side in the X axis direction of the end portion 112 of the radiating element 110 of the simulation model 100A illustrated in FIG. 5, a metal member 27 that has a rectangular parallelepiped shape coupled to the edge L2 of the ground plane 20. In such a simulation model 100B, the distance X is changed as illustrated in FIGS. 7A and 7B.

Figure 8A:
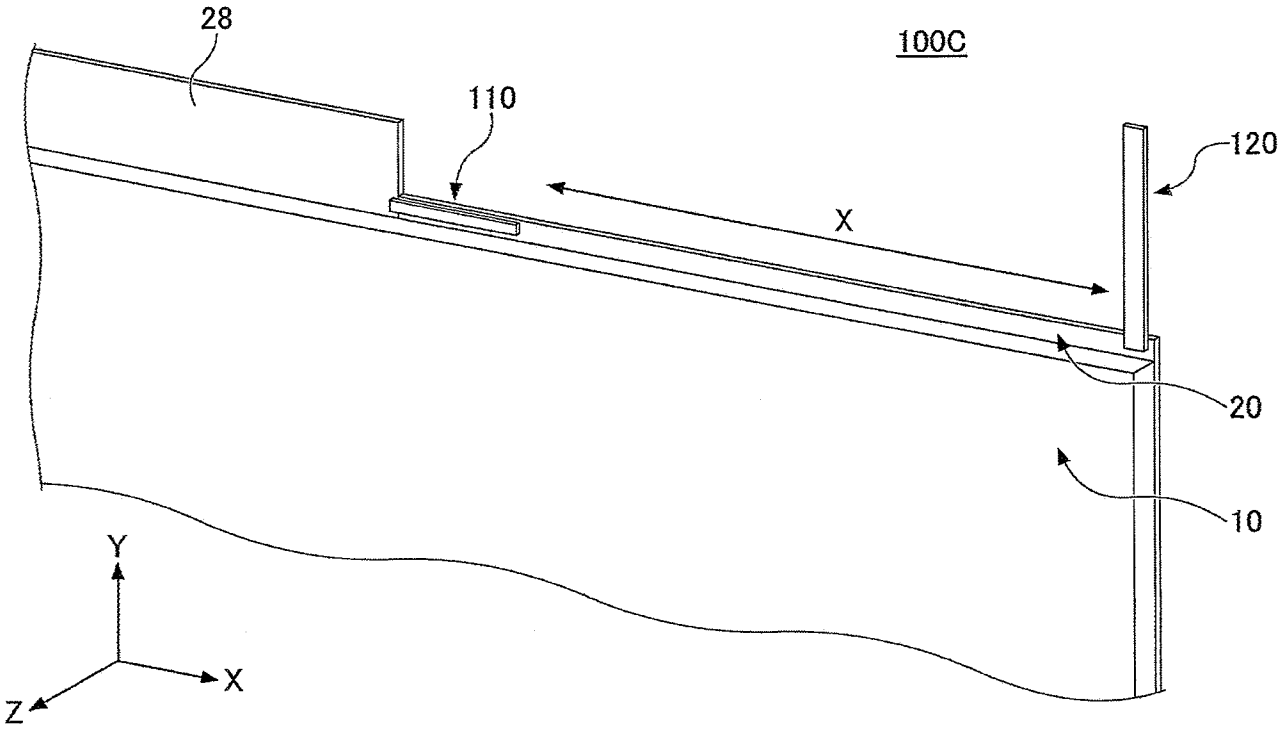
FIGS. 8A and 8B are diagrams illustrating a simulation model 100C.
Figure 8B:
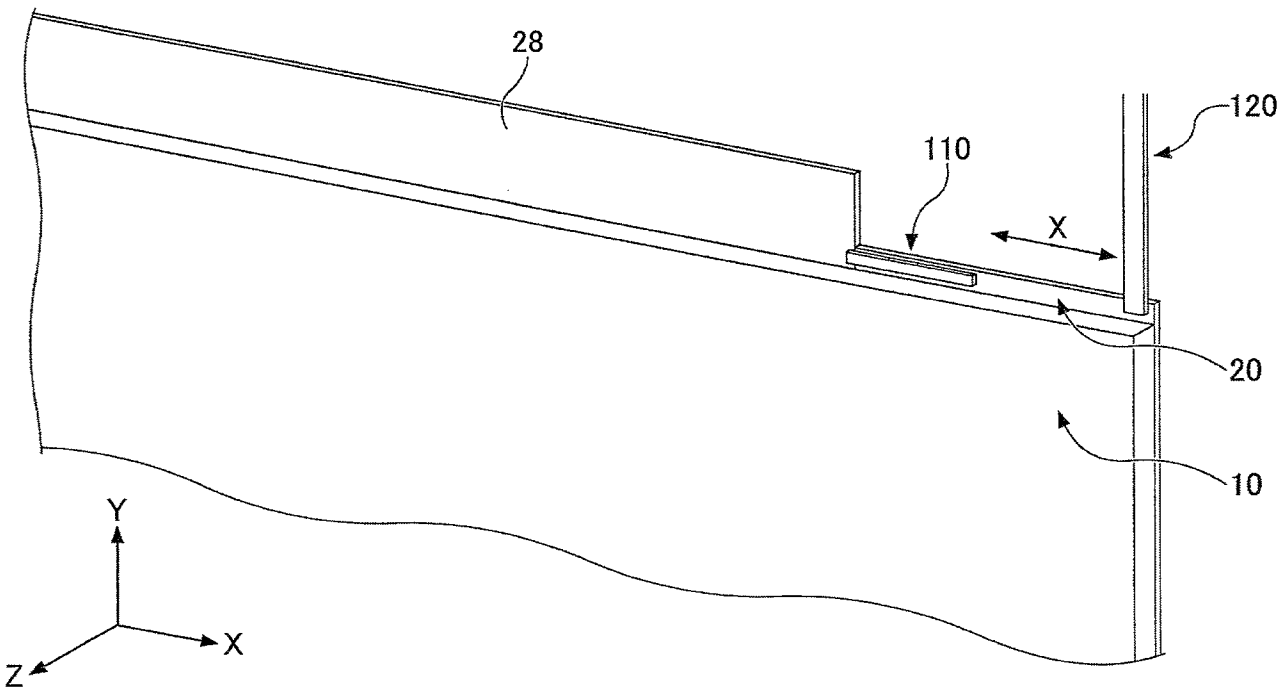

Further, the simulation model 100C illustrated in FIGS. 8A and 8B is a simulation model obtained by adding, to the negative side in the X axis direction of the end portion 112 of the radiating element 110 of the simulation model 100A illustrated in FIG. 5, a ground element 28 coupled to the edge L2 of the ground plane 20.

The ground element 28 has a thickness (length in the Z axis direction) equal to that of the ground plane 20 and is formed to be integral with the ground plane 20. In other words, the simulation model 100C has a configuration in which the ground plane is cut out by a portion where the radiating elements 110 and 120 are present.

In such a simulation model 100C, the distance X is changed as illustrated in FIGS. 8A and 8B.

Figure 9:
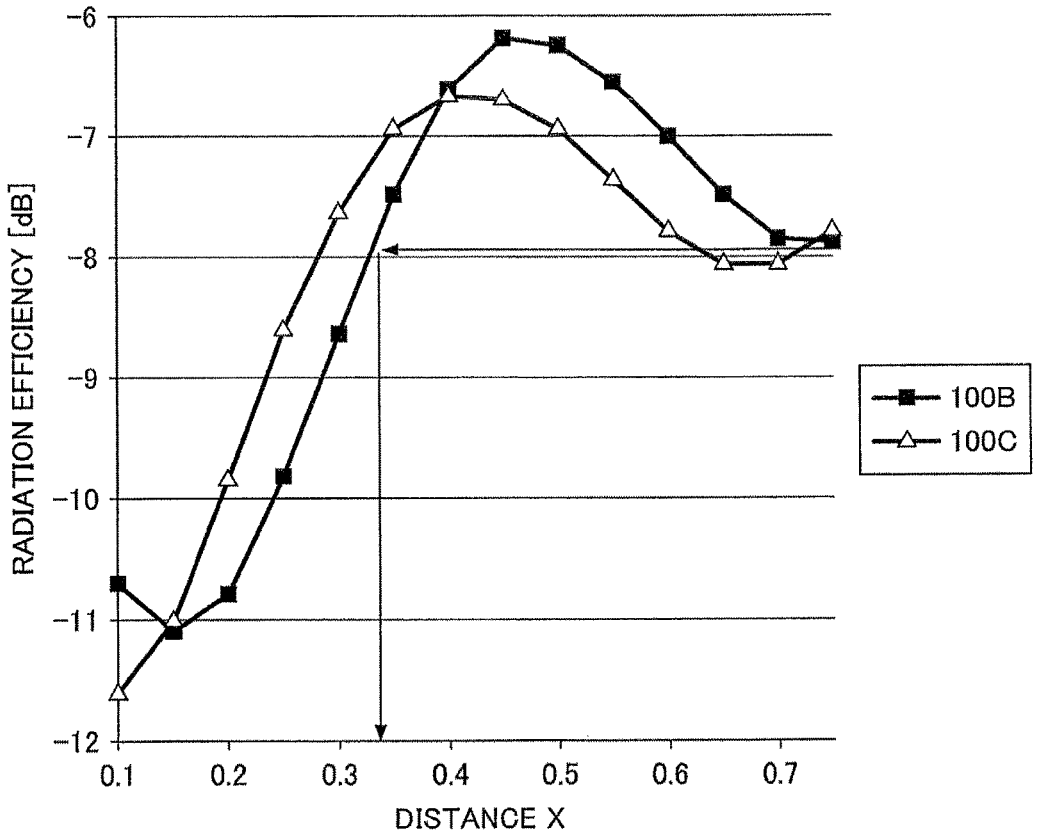
FIG. 9 is a diagram illustrating a property of a radiation efficiency of the radiating element 110 with respect to the distance X between the radiating element 110 and the radiating element 120 in each of the simulation models 100B and 100C.

FIG. 9 is a diagram illustrating a property of a radiation efficiency of the radiating element 110 with respect to the distance X between the radiating element 110 and the radiating element 120 in each of the simulation models 100B and 100C.

As illustrated in FIG. 9, as the distance X is increased from $0.1\lambda_1$ in the simulation models 100B and 100C, the radiation efficiency of the radiating element 110 increases. The radiation efficiency of the radiating element 110 of the simulation model 100B takes the maximum value (which is approximately −6.2 dB) when the distance X is approximately $0.43\lambda_1$. The radiation efficiency of the radiating element 110 of the simulation model 100B is substantially saturated when the distance X is greater than or equal to approximately $0.7\lambda_1$.

Further, the radiation efficiency of the radiating element 110 of the simulation model 100C takes the maximum value (which is approximately −6.6 dB) when the distance X is approximately $0.4\lambda_1$. The radiation efficiency of the radiating element 110 of the simulation model 100C is substantially saturated when the distance X is greater than or equal to approximately $0.7\lambda_1$.

As described above, the simulation model 100B, having the added metal member 27, and the simulation model 100C, having the added ground element 28, differ in the distance X at which the maximum value is obtained and also somewhat differ in the maximum value, but have properties similar to the property illustrated in FIG. 6.

Specifically, according to the simulation model 100B, obtained values of the radiation efficiency in a case where the distance X is in a range of from approximately $0.32\lambda_1$ to approximately $0.75\lambda_1$ are greater than or equal to those of the radiation efficiency in a case where the distance X is longer than approximately $0.75\lambda_1$. Further, according to the simulation model 100C, obtained values of the radiation efficiency in a case where the distance X is in a range of from approximately $0.25\lambda_1$ to approximately $0.63\lambda_1$ are greater than or equal to those of the radiation efficiency in a case where the distance X is longer than approximately $0.63\lambda_1$. The case in which the distance X is longer than approximately $0.75\lambda_1$ and the case in which the distance X is longer than approximately $0.63\lambda_1$ are equivalent to the case in which the radiating element 110 is used alone.

As described above, it is found, from the results of FIG. 6 and FIG. 9, that a value of the radiation efficiency in a case in which the distance X is in a range of from approximately $0.25\lambda_1$ to approximately $0.7\lambda_1$ is greater than or equal to that of the radiation efficiency in a case in which the radiating element 110 is used alone.

Figure 10:
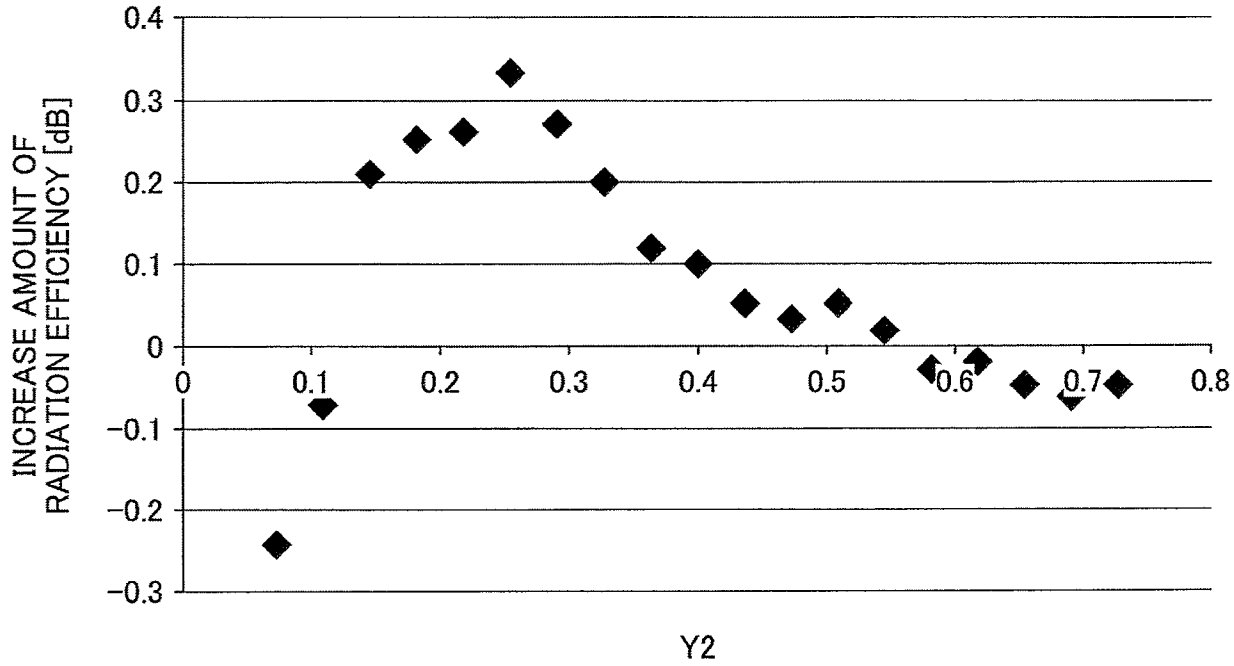
FIG. 10 is a diagram illustrating a change of an increase amount of the radiation efficiency in a case where the length of the radiating element 120 is changed in the simulation model 100A illustrated in FIG. 5.

FIG. 10 is a diagram illustrating a change of an increase amount of the radiation efficiency in a case where the length of the radiating element 120 is changed in the simulation model 100A illustrated in FIG. 5. FIG. 10 illustrates a simulation result in a case where only the radiating element 110 is fed with power and the radiating element 120 is not fed with power and is terminated by a 50Ω resistor.

Here, the length of the radiating element 120 illustrated by the horizontal axis of FIG. 10 is the length from the feed point 121 to the end portion 122 of the radiating element 120 illustrated in FIG. 5. Here, the length of the radiating element 120 is referred to as the length Y2. Note that the length Y2 is represented by numerical values standardized (divided) by the wavelength $\lambda_1$. Further, the vertical axis represents an increase amount of the radiation efficiency (dB) of the radiating element 110 for when power is fed to only the radiating element 110. The increase amount is an amount of increase relative to a case in which the radiating element 110 radiates alone in a state in which a radiating element 120 is not present.

As illustrated in FIG. 10, the increase amounts are in negative values when the length Y2 is shorter than $0.15\lambda_1$, and the increase amounts are in positive values when the length Y2 is in a range of from $0.15\lambda_1$ to $0.55\lambda_1$. Further, when the length Y2 is longer than or equal to $0.6\lambda_1$, the increase amounts are in negative values.

As described above, it is found that, by setting the length of the radiating element 120 to be in a range of from 0.15-fold to 0.55-fold of the wavelength $\lambda_1$ of the communication frequency f1, the radiation of the radiating element 110 is supported by the radiating element 120 and the radiation efficiency of the radiating element 110 is improved.

Figure 11:
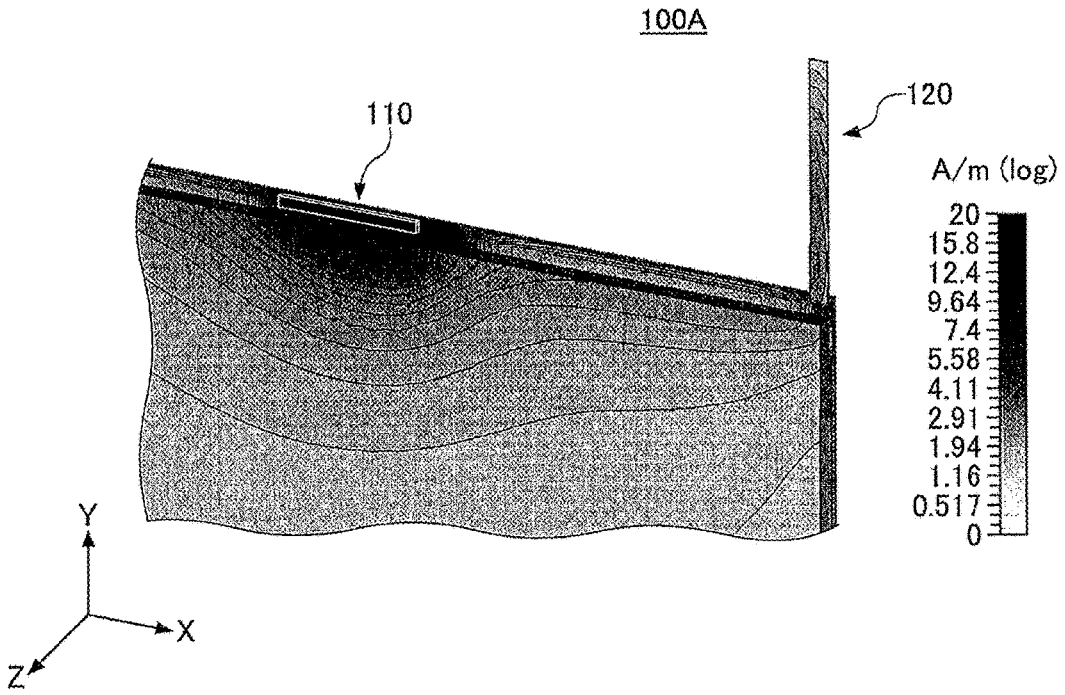
FIG. 11 is a diagram illustrating a simulation result of an electric current density of the simulation model 100A.

FIG. 11 is a diagram illustrating a simulation result of electric current density of the simulation model 100A. The simulation result illustrated in FIG. 11 is obtained, in an electromagnetic field simulation, by feeding power only to the radiating element 110 in a state in which the feed point 121 of the radiating element 120 is terminated by a 50Ω resistor. In FIG. 11, as the electric current density (A/m) increases, the portion is indicated as darker (black), and as the electric current density decreases, the portion is indicated as lighter (white).

As illustrated in FIG. 11, it is found that, in a state in which power is fed only to the radiating element 110, an electric current flows not only in and around the radiating element 110 but also flows in the radiating element 120. In particular, it is found that the color at the feed point 121 of the radiating element 120 is thick, the electric current density at the feed point 121 of the radiating element 120 that serves as a monopole antenna is high, and the radiating element 120 also radiates while the power is fed only to the radiating element 110.

That is, it can be confirmed that radio waves radiated by the radiating element 110 are reradiated by the radiating element 120 in a state in which the radiating element 110 and the radiating element 120 are coupled as appropriate.

As described above, when the radiating element 110 and the radiating element 120 satisfy such following conditions, the total efficiency can be increased by the radiating element 120 reradiating radio waves radiated by the radiating element 110 relative to a case in which the radiating element 110 is used alone.

First, as a precondition, the end portion 112 of the radiating element 110 is arranged closer to the ground plane 20 than the end portion 122 of the radiating element 120 is. That is, the coupling between the radiating element 110 and the ground plane 20 is stronger than the coupling between the radiating element 120 and the ground plane 20.

Then, the distance X between the feed point 111 of the radiating element 110 and the feed point 121 of the radiating element 120 is in a range of from $0.25\lambda_1$ to approximately $0.7\lambda_1$. This condition is derived from FIG. 6 to FIG. 9.

Further, the length Y2 of the radiating element 120 is in a range of from $0.15\lambda_1$ to approximately $0.55\lambda_1$. This condition is derived from FIG. 10.

When such conditions are satisfied, as can be confirmed in FIG. 11, the total efficiency can be increased by the radiating element 120 reradiating radio waves radiated by the radiating element 110 relative to a case in which the radiating element 110 is used alone.

Therefore, according to the embodiment, it is possible to provide the antenna apparatus 100 and the tablet computer 500 that have improved efficiency. The antenna apparatus 100 illustrated in FIG. 3 and FIG. 4 is a multi-band type antenna apparatus that is able to communicate at three frequencies f1, f2, and f3. Note that the communication frequency f1 may be 2.4 GHz, the communication frequency f2 may be 2 GHz, and the communication frequency f3 may be 800 MHz, for example.

According to the antenna apparatus 100, even when the radiating element 120 is used, a value of the return loss is similar to that for when the radiating element 110 is used alone, and the radiation efficiency is improved. Therefore, the total efficiency can be improved.

Further, because the radiating element 110 is arranged close to the ground plane 20 and along the surface of the ground plane 20 to be at a very low position, it is possible to reduce the size of the radiating element 110.

Further, although the length of the radiation part 120A is longer than the radiating element 110 and the communication frequency f2 is lower than the communication frequency f1 in the embodiment described above, the length of the radiation part 120A may be shorter than the radiating element 110 and the communication frequency f2 may be higher than the communication frequency f1. Similarly, the length of the radiation part 120A may be longer than the length of the radiation part 120B, and in this case, the communication frequency f2 is lower than the communication frequency f3.

Further, although the radiating element 120 is a T-shaped antenna element in FIG. 3 in the embodiment described above, the radiating element 120 may be a linear antenna element as illustrated in FIG. 5 without branching off or may be an antenna element obtained by bending the radiating element 120 illustrated in FIG. 5. Further, a plurality of branch elements may be coupled to the radiating element 120. In such a case, it is possible to increase the number of communication frequencies to 4 or more. Further, although the radiating element 120 is provided inside the housing 500A in the embodiment described above, the radiating element 120 may be provided outside the housing 500A.

Further, a plurality of branch elements may be coupled to the radiating element 110. In such a case, the radiating element 110 can increase the number of communication frequencies to 4 or more.

Further, although the feed point 111 is located at one end of the radiating element 110 and near the ground plane 20 in the embodiment described above, the feed point 111 is not required to be located at an end portion of the radiating element 110 and is not required to be located near the ground plane 20. For example, the radiating element 110 may be arranged such that the radiating element 110 has a shape bent into a reverse-U-shape, the feed point 111 is located at the bend part, and both ends of the radiating element 110 are arranged closer to the ground plane 20 than the end portion of the radiating element 120 is. In such a case, the radiating element 110 is not arranged along the edge L2 of the ground plane 20.

Further, although the feed point 121 is located at one end of the radiating element 120 and near the ground plane 20 in the embodiment described above, the feed point 121 is not required to be located at an end portion of the radiating element 120 and is not required to be located near the ground plane 20. It is sufficient that the radiating element 120 is located such that the end portion 122 is located farther away from the ground plane 20 than the end portion 112 of the radiating element 110 is.

In addition to or instead of inserting (loading) an inductor in series with the feed point 111 and/or coupling (loading) a capacitor in parallel with the feed point 111, an inductor may be inserted (loaded) in series with the feed point 121 and/or a capacitor may be coupled (loaded) in parallel with the feed point 121. Either an inductor or a capacitor may be loaded for impedance matching.

Further, the radiating element 110 may be shorter than a quarter wavelength of an electrical length of the wavelength $\lambda_1$. That is, the radiating element 110 may be shorter than $\lambda_1/4$. For example, by inserting (loading) an inductor in series with the feed point 111 and coupling (loading) a capacitor in parallel with the feed point 111, the radiating element 110 can be made shorter than $\lambda_1/4$ (for example, the radiating element 110 can be made into approximately $\lambda_1/10$). In such a case, it is possible to further reduce the size of the radiating element 110.

Further, the radiating elements 110 and 120 may have bent shapes or turned shapes such as a meandering shape and a spiral shape.

Although examples of the antenna apparatus and the electronic device according to the embodiment of the present invention have been described above, the present invention is not limited to the embodiment specifically disclosed and various variations and modifications may be made without departing from the scope of the present invention.

All examples and conditional language provided herein are intended for pedagogical purposes of aiding the reader in understanding the invention and the concepts contributed by the inventors to further the art, and are not to be construed as limitation to such specifically recited examples and conditions, nor does the organization of such examples in the specification relate to a showing of superiority and inferiority of the invention. Although one or more embodiments of the present invention have been described in detail, it should be understood that various changes, substitutions, and alterations could be made hereto without departing from the spirit and scope of the invention.

What is claimed is:

1. An antenna apparatus comprising:

a ground plane having an edge;

a monopole first antenna element having a first feed point and configured to communicate at a first frequency;

a monopole second antenna element having a second feed point and configured to communicate at a second frequency, the monopole second antenna element extending from the second feed point in a direction away from the edge; and a branch element that branches off from the second antenna element, wherein the second antenna element and the branch element are a T-shaped antenna element branching in a T-shape, wherein an end portion of the first antenna element is arranged closer to the ground plane than an end portion of the second antenna element is, wherein a length of an interval between the first feed point and the second feed point is in a range of from 0.25-fold to 0.7-fold of an electrical length of a first wavelength at the first frequency, and wherein a length of the second antenna element is a length in a range of from 0.15-fold to 0.55-fold of the electrical length of the first wavelength.

2. The antenna apparatus according to claim 1, wherein an interval between the end portion of the second antenna element and the ground plane is wider than an interval between the end portion of the first antenna element and the ground plane.

3. The antenna apparatus according to claim 1, wherein an interval second feed point and the ground plane is wider than an interval between the first feed point and the ground plane.

4. The antenna apparatus according to claim 1, wherein the ground plane is provided on a substrate, and wherein the second antenna element is held by a housing including the substrate.

5. An electronic device comprising:

a housing; and the antenna apparatus according to claim 1 disposed inside the housing.

* * * * *